United States Patent [19]

Müller

[11] 4,319,990

[45] Mar. 16, 1982

[54] APPARATUS FOR THE DRY CLEANING OF GRAIN

[75] Inventor: Roman Müller, Niederuzwil, Switzerland

[73] Assignee: Gebrueder Buehler AG, St. Gallen, Switzerland

[21] Appl. No.: 113,318

[22] Filed: Jan. 18, 1980

[30] Foreign Application Priority Data

Jan. 19, 1979 [CH] Switzerland ..... 553/79

[51] Int. Cl.[3] ..... B07B 1/46

[52] U.S. Cl. ..... 209/240; 209/253; 209/255; 209/315; 209/365 R

[58] Field of Search ..... 209/240, 243, 244, 245, 209/311, 315, 317, 319, 365 R, 369, 370, 253, 255

[56] References Cited

U.S. PATENT DOCUMENTS

| | | | |
|---|---|---|---|
| 627,735 | 6/1899 | Hynes | 209/240 |
| 2,297,486 | 9/1942 | Linke et al. | 209/311 X |
| 2,965,233 | 12/1960 | Müller | 209/365 R |
| 2,978,104 | 4/1961 | Müller | 209/365 R |
| 3,040,890 | 6/1962 | Eppenberger | 209/319 |
| 3,087,617 | 4/1963 | Forsberg | 209/319 |
| 3,688,902 | 9/1972 | Hubach | 209/240 |

*Primary Examiner*—William A. Cuchlinski, Jr.
*Attorney, Agent, or Firm*—Oblon, Fisher, Spivak, McClelland & Maier

[57] ABSTRACT

The invention relates to the dry cleaning of grain and discloses a new process and an apparatus. In the new process a deep layer of grain is formed on an upper screen, the holes of which are larger than the grain particles, and a compacting effect is produced in the bottom zone of the layer by vibratory forces. Sand particles sink into the layer compacting near the screen, and this layer drops completely—i.e. together with the sand particles—directly on to a second screen situated therebeneath. The sand passes through the bottom screen. The double screen is preferably preceded by a coarse screen. The apparatus is modular and comprises as separate modules a screen box, a head section containing the grain inlet and a tail section containing the outlets. A number of screen boxes of different sizes and head and tail sections of different sizes and arrangements may be provided to make it possible to supply a number of screening systems of different sizes. In the most advantageous construction, the head section and the tail section have adjustable or replacable flow guides to enable the product to be guided in different ways to and from the screens.

17 Claims, 13 Drawing Figures

84
85
91
92
105
104

109
110
83
82
81
80
103
106
102
101
100
91
92
107
86
87
88
89
90
108

APPARATUS FOR THE DRY CLEANING OF GRAIN

BACKGROUND OF THE INVENTION

This invention relates to a method for the dry cleaning of grain by means of screens and gravity separation, more particularly for the removal of undesired impurities, e.g. parts of high specific gravity, such as sand, and lightweight particles.

The majority view in the grain-processing industry today is that dry cleaning gives a cleaning effect equal to what could be obtained only with additional washing or a water bath up to a few years ago. Apart from the economy of any particular process, an increasingly important consideration is that the equipment required for the process should produce the minimum environmental pollution. Except in special cases, therefore, wet cleaning, with the large quantities of waste water that it produces, is no longer used.

The main object of this invention is to improve the dry cleaning of grain mainly in grain silos and mills, for preparation for grinding by means of roller mills, and also for cleaning seed grain. Numerous industrial grading processes are known, for example as in the processing of sand and gravel. It is an interesting fact that the production of the highest grades of, for example, concrete gravel, entails the screening and washing thereof. One reason for this is that earthly constituents, and particularly organic constituents, can only be reliably separated with wash water because of their different specific gravity.

Grain cleaning has to deal with separation by size, separation by specific gravity, and in addition separation by external shape, e.g. long grain and round grain. All three separation problems are today solved by purely dry methods in grain cleaning, despite the fact that the mass flows involved are up to 150 t and more per hour per machine, and this means quantities which are not very far away from the dimensions of the corresponding sand-preparing plant.

In operation, the mass flows are deflected and divided in such a way that undesirable impurities are not carried along with the grain.

An existing grain cleaning system comprises the following five main process stages:

1. Coarse pre-screening—a coarse screen frequently combined with a sand screen
2. Separation into heavy and light fractions—concentrator
3. Settling out of stones and the like—stone separator
4. Separation of light impurities—light particle separator and/or aspiration channel
5. Surface cleaning—scourer with a cylindrical screen and rotor.

The main impurities separated are sand and stones, earthy constituents, foreign seeds, husks and straw, large particles such as pieces of wood, and dust so that ultimately the sound grain is obtained as a clean fraction.

The term sand denotes all sandy particles smaller than the size of the sound grain particles. To avoid the sand fraction containing too many grain particles, the smaller grain particles are preferably used as a reference size in practice to determine the perforation of the sand screen. However, it must be remembered that the effective aperture size in a vibrating screen is somewhat smaller than the actual size of the aperture because of the vibration and any inclination.

The degree of separation with the equipment used at the present time in grain cleaning is very high, both for the light constituents and for the heavy constituents. Of course the separation of small stones, sand particles, and so on, is more difficult without the use of water because their specific gravity is only about twice that of the grain particles, and this of course is independent of size. The stones are practically 100% separated in a pulsating air current provided they are larger than the grain particles, but the separation of sand using the stone separator is imperfect. If the sand is finer than the grain particles, it is child's play to screen sand out of a large quantity of larger grain particles, just by screening. This applies on both the small scale and a large scale. The technical solution has long been known, the sand screen being subjected to such loading, or the plant being so enlarged, that practically 100% of the sand fraction can fall through the screen and be separated. However, to increase the screen output requires extra investment, extra energy and extra space.

At the present time, the said sand fraction is not screened out at the beginning as would be expected, but in most cases is done in the following stages. The sand which does not fall through the first screen is concentrated into a light fraction in the concentrator, and then in the next stage is, as it were, rubbed through the surrounding screen of a scourer by means of a high-speed rotor having a large number of percussive strips. Obviously, the larger the sand fraction, the greater the wear on high-speed parts. The fact that a large proportion of sand accumulates at two or three places in the screening circuit is particularly undesirable in many cases, and in particular it makes the setting up of all the machines difficult.

If a high proportion of sand is left in the grain, then the following machines—and particularly the rolls of roller mill trains—will be subjected to correspondingly greater wear. The resulting flour has a relatively high ash value and in many cases this is noticed only occasionally or else only after some period of operation; it is then frequently tolerated.

The main object of the invention is to improve dry cleaning, particularly in respect of sand separation. A decisive factor to this solution is that it should be little or no more expensive in terms of construction and operation than the cleaning plant conventional heretofore.

SUMMARY OF THE INVENTION

The present invention attains these objects by a process in which in a first stage the grain is fed to a double screen, the retained material of each of the two screens containing some of the grain, and finer particles such as sand are screened out by the double screen and the retained material from the top screen and the retained material from the bottom screen are fed to a following stage for gravity separation to eliminate further impurities.

Preferably, the top screen has a larger perforation, e.g. 3–8 and preferably 4–6 mm, in the case of wheat, while the lower screening layer has a smaller perforation, e.g. 1.5–3 mm. The values are correspondingly larger in the case of maize, for example.

It is not surprising that those versed in the art initially regarded the new process with scepticism and rather as being opposed to strict technical logic. It was argued that even with the new invention it would not be possible to separate reliably in the first stage that sand which did not drop from the upper screen on to the bottom screen. The sand particles which drop on to the bottom screen would, so it was argued, have to find a path through the flow of grain on the bottom screen. This argument overlooks the fact that any separating process for a mixture of bulk material represents a very complex and to some extent contradictory process. The screening of a bulk material naturally requires shaking movements or vibrations, but it is common knowledge that shaking and vibrating also cause a mixing and compaction effect. The vibration of concrete gives it maximum packing density, the large and small particles tending so to arrange themselves that the small particles assume positions in the cavities between the larger particles. It is also known that a sequence of events—stationary bulk material, maximum fluidity compaction phase—solidification in the densest phase—takes place in concrete vibration. If the entire mass of bulk material is shaken or vibrated as a whole, then very frequently the tendency is for the compaction effect to start more rapidly and initially at the bottom of a thick layer. It is precisely here that the invention starts. Instead of feeding the flow of grain in two streams to an upper screen and to a lower screen, the entire flow of product is fed to the top screen in a relatively thick layer. The possibility of compaction in the top screen is as it were taken away from the floor, because the bottom-most compacting layer—sound grain particles and sand—falls through. An ideal screening technique can therefore be applied, whether in terms of layer thickness, perforation size, screen length, vibration intensity, and so on, on the bottom screen with a small quantity of product, e.g. half or much less. Of course there are many other effects which assist the success of the invention.

One of the basic principles of the new invention is that a screening concentrate for the fine particles is formed in a first cleaning stage and a gravity concentrate in the second stage. The fine and particularly heavy fraction is separated in the optimum manner with the screening concentrate. As a purely auxiliary measure, some assistance may be given by suction in forming the screen concentrate. The gravity concentrator, on the other hand, operates by vibration and controlled air throughflow.

The loading on the last stage of the cleaning system, i.e. stone separator, scourer and so on, is relieved by the new invention and the last stage is also improved. The invention permits the simplest way, which was previously not chosen for economic reasons, by screening out what has to be screened out and separating by gravity what is readily separable by gravity.

The retained material from the upper screen and from the lower screen can be combined and fed jointly to the gravity separation stage or else the retained material from the top and bottom screens can be separated into two fractions, i.e. one fraction as a concentrate of particles with sand and one fraction of particles without sand, and the concentrate can be fed to a gravity separation stage.

It has been found that a coarse screen, i.e. a preliminary screening for the removal of coarse impurities, is advantageously provided in front of the first screening stage.

Preferably, the coarse screen is disposed directly above the double screen. This gives uniform product feed to the double screen.

Surprisingly good results are obtained if the screening system in the double screen is set into linear vibration, particularly when the linear vibration extends in the direction from the product inlet to the outlet for material retained by the screen or is inclined thereto. A gyratory vibration has also proved satisfactory in certain cases.

To make the method universally adaptable to grain cleaning, it is also proposed that there may be three or more screens instead of the double screen.

As already stated, the top screen should have a larger effective perforation size than the size of the grain particles so that some of the latter is discharged as retained material from the upper screen and some of the flow of cereal drops on to the bottom screen, and the top screen is preferably parallel or substantially parallel to the bottom screen.

It is also proposed that the bottom screen should have an effective perforation size equal to or smaller than the size of the "sound" grain particles.

By adjustment of the direction and intensity of vibration and by selection of the correct screen it is possible in a relatively simple manner to ensure in any given case that a deep layer is formed on the top screen and a compacted layer is formed in the zone close to the screen as a result of the vibratory forces, the compacted layer more particularly containing the sand which drops as screenings on to the bottom screen.

Consequently, two fractions are formed from the retained material from the top and bottom screens, i.e. one fraction as a concentrate of particles with the remaining heavy components and one fraction of particles without heavy components, and the concentrate is passed to a gravity separation stage for separation of the remaining heavy and light impurities.

As already suggested, it is preferred for the entire flow of grain to be supplied to the top screen. The said following stage is preferably a concentrator. Part of the discharge from the concentrator may be passed to a stone separator while another part may be passed to a scourer.

The invention further relates to apparatus for the dry cleaning of grain, more particularly a screening system for removing at least some of the small impurities.

In practice, in many applications screening systems are preferred which have a gyratory movement after the style of a plan sifter. The screening system or at least the screening frames alone are brought into a gyratory vibratory movement by means of a rotary eccentric rotating about an approximately vertical axis. The product conveyance can take place in any direction viewed in a horizontal plane. With the gyratory movement, therefore, there is a free choice of the arrangement of product inlets and outlets. Consequently, for example, the screen frames can be slightly inclined or disposed completely horizontal and superposed in a number of layers. Cleaning members may also be provided between two screening layers effectively to clean the entire screen surface by the gyratory movement. For the above advantages, applicants themselves successfully use this system in mills, more particularly for screening grain, and also for producing flour and so on. This system is today generally acknowledged in this area by those versed in the art.

Screening systems with linearly moving frames have a simpler construction and permit a higher product throughput in many applications. However, it is well known that the linear movement has the disadvantage that the screens are sensitive to fluctuations in the product throughput and on a changeover from one material to another. An open screen construction can be continuously monitored visually and immediately remedied in the event of malfunction. However, open screens are not permissible in food plant because of the dust. Visual inspection is difficult in the case of a screening box in the form of a closed trough, so that throughput is lower and the vibration intensity must be set to an adequate value. It is always necessary to adapt the simple basic structure of the screening system in the case of a trough-shaped screening box to requirements at any particular time.

The object of a further feature of the invention is to provide an apparatus which is cheap to manufacture, enables the process to be performed, and more particularly allows universal adaptation to most screening problems known at the present time in grain processing.

It has been possible to solve this problem in a surprisingly simple manner by providing the apparatus with a modular type of housing construction with a screen box in the form of a closed trough as the basic unit.

It has recently been disclosed to construct open screens on the modular principle in the rock industry. However, the principle of that modular system is designed for a relatively free choice of screen size, a larger or smaller number of screening elements being assembled to form a larger or smaller screening system.

The present invention, however, does not propose to form a "size" modular system, but a "function" modular system, the basic principle of the invention being that the screen box is the basic element of the modular system. It has been found that the new principle of the special modular system gives unexpected advantages in the dry cleaning of grain, both to the manufacturer and to the client. With the new method, the client can either buy a reserve for increased output, double the output in the extreme case, or a corresponding increase in quality with equipment which is only slightly larger in its external dimensions, for the price of the screening equipment known heretofore, and can obtain the maximum screening effect subsequently with the apparatus expanded to its maximum, and in addition, and this is particularly advantageous, has available universal adaptability of his plant for subsequent modification of special operating requirements, other raw materials, other finished products, and so on.

Preferably, further elements of the casing are a head section containing the product inlet and a tail section containing the product outlets; these are constructed as separate modules. A very great technical advance is afforded by the possibility of forming a module with the guide members necessary to produce a desired product flow pattern. Preferably, these are constructed directly as a unit with the head section or tail section.

The invention now enables a standard screen box to be used with screen frames suitable for the specific application, such frames being introducible into the box. The entire box together with the frame can be set to different inclined positions and also be adapted to the projection angle of the vibrator, without automatically producing a negative vibrational characteristic, e.g. tumbling movements.

Providing a releasable head section has resulted in an ideal solution both in respect of the said functions and in respect of change of screen and adjustment of the flow pattern members for different screening jobs, for where the screening system hitherto had to be designed for a particular application, adaptability now is restricted, insofar as directly concerns manufacture, to the smallest possible component, i.e. the releasable head section. The screening system can be built up on the modular system, the most important elements remaining the same but being adapted to fitting in different positions.

The invention allows various advantageous developments. Preferably, a releasable head section is disposed on the closed trough-shaped screen box and the vibrator is so disposed thereon that the resulting vibratory forces are introduced substantially centrally to the box. In one good solution, the vibrating means comprises two rotary eccentric vibrators mounted one on each side of the screen box approximately midway along its length and arranged to produce in the screen box a linear vibration lengthwise of the box. The vibrators may be adjustably mounted on the screen box to be rotatable about a horizontal axis for adjustment of the inclination of the direction of the vibratory impact. Alternatively, the vibrating means may comprise two rotary eccentric vibrators mounted one above and one beneath the screen box with their axes approximately vertical to produce in the screen box an approximately horizontal gyratory vibration.

In a very advantageous embodiment of the apparatus which is convenient and progressive in respect of cleaning, the head section, which contains the flow pattern parts for the product, is removable as a whole. The best solution is for the flow pattern parts to be capable of being released, preferably with the head section, by means of catches, quick-action fasteners or the like, and for the screen frames to be withdrawable in the longitudinal direction when the head section has been released.

The entire head section may be attached to the screen box by releasable catches and the screens are adapted to be withdrawn from the screen box longitudinally when the head section has been released. Also, the head section may be connected to the screen box by a hinge and can be swung clear when the catches are released.

These features enable the technician to use, inspect and adapt the screening system to fluctuating requirements in a manner unknown heretofore. The resulting plant is thus no longer sealed, but is open and the miller or responsible technician can expand the system as required.

Easy change of screens is provided by making the screens (and their support frames) introducible and withdrawable in the manner of drawers. A separating floor can also be introduced between two screen frames when two parallel runs or two different products have to be cleaned. Of course it is possible, although not essential, for the individual screen frames to be installed with slightly different inclinations. It is possible to provide for the direction of vibration relative to the plane of the screens and for the intensity of the vibratory forces to be adjustable.

Although it is desirable to introduce the vibratory forces exactly at the centre of gravity or through a correspondingly imaginery horizontal line of gravitational symmetry, a slight deviation therefrom does not matter.

The vibrators are preferably disposed substantially centrally on the screen box. A structural modification of the head or tail section may result in a change of the position of the centre of gravity but it will usually be unnecessary to change the positions of the vibrators or to attach additional weights. The modular system additionally provides into the bargain a very wide range of possibilities of directly connected units, e.g., two screening systems can be disposed directly above or next to one another or seriatim.

The screening system is advantageously secured to the screen box via damping or spring elements and is preferably attached adjustably to a machine frame so that the box can be adjusted to different inclined positions.

To meet a particular order, only the side of the screening machine and the appropriate head section has to be designed or selected from existing designs and, on commissioning, or in the event of any change in the intended purposes, the appropriate section is fitted and the optimum values set for the angle of vibration and screen inclination. If the above factors are correctly selected (i.e. head section, screen, screen inclination and angle of vibration), and also the intensity of the vibration, then very high values can be obtained for product throughput with increased screening quality using a screening system requiring very little expenditure in terms of construction. The possibilities in respect of screening quality using linear vibratory movement were presumably denied heretofore because the tendency was always to adapt the construction to specific cases from the very outset, and this precluded deliberate adjustability on commissioning, for example, because of the necessary extra expense involved in manufacture.

The invention proposes precisely the reverse method, i.e. maximum versatility of the basic construction for manufacture, to offer the maximum possible variation to meet specific cases. This allows large volume production with corresponding advantages. It was hitherto considered impossible to construct on the modular principle a screen system for such a wide range of applications as is now offered. By combining the method of the invention with the modular construction, the screen is given another novel function beyond its conventional screening function, i.e., half screening and half sedimentation or compaction thus allowing overall a considerable advance in grain cleaning.

The invention may be carried into practice in various ways but a number of grain cleaning processes and screening apparatus therefor and embodying the invention will now be described by way of example with reference to the accompanying drawings.

DESCRIPTION OF THE PREFERRED EMBODIMENTS

Figure 1:
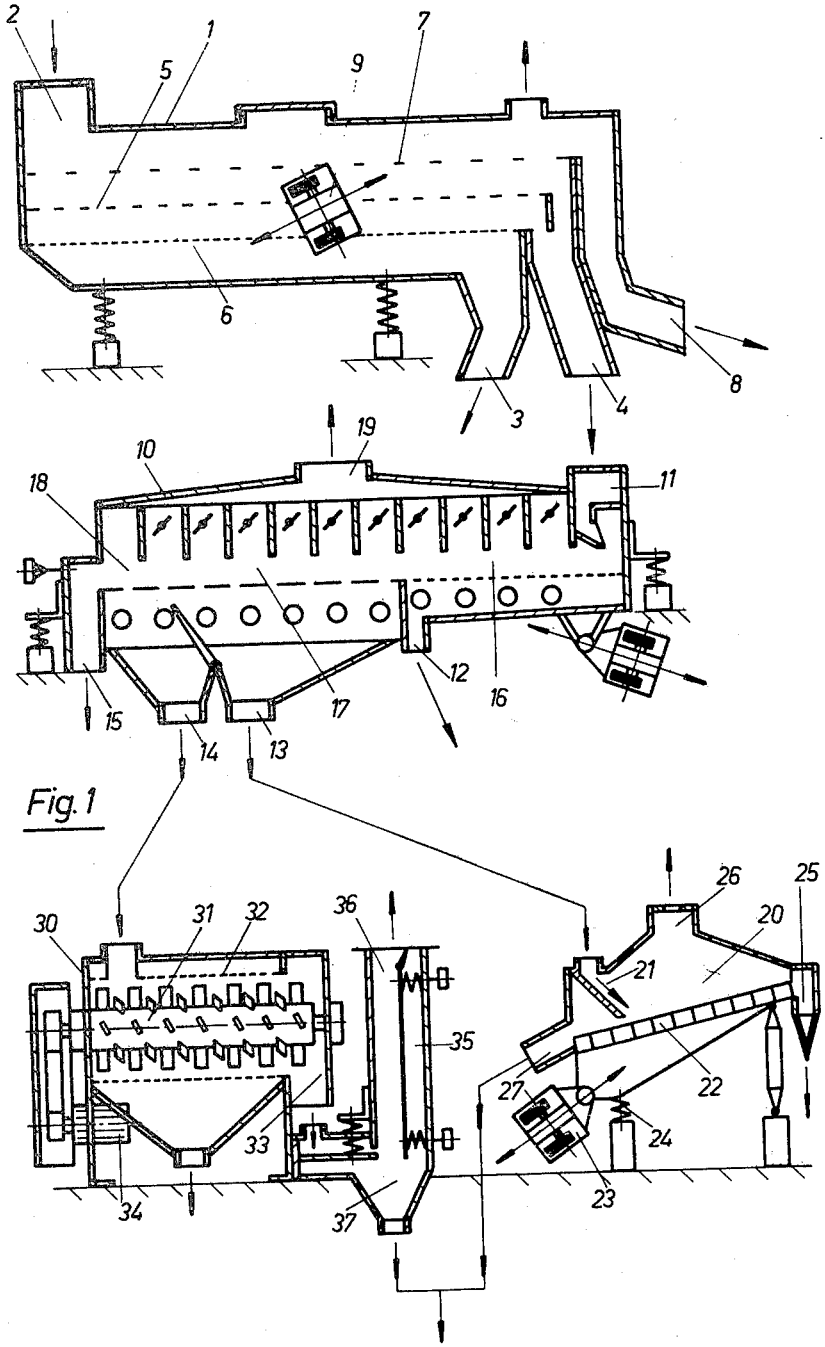
FIG. 1 shows diagrammatically the flow of grain through a grain cleaning plant for soft wheat.

The first unit of the soft wheat cleaning plant shown in FIG. 1 is a grain separator 1 and it is to this unit that the invention is primarily directed. The separator 1 has a vibrator 9, a grain inlet 2 and three parallel screens 7, 5 and 6. The uppermost screen 7 is a coarse screen through which grain and similar sized particles readily fall but which retains large foreign constituents such as pieces of string, lumps of earth, pieces of metal, straw, etc., the overs passing to an outlet 8. Some of the grain passes through the second screen 5 together with small stones and sand but substantially no grain passes through the third screen 6. Overs from the second and third screens pass to a common outlet 4 while throughs pass to a sand outlet 3.

From the outlet 4 the grain is transferred to a concentrator 10 in a second stage of the process. The concentrator comprises a product inlet 11 and four outlets 12 to 15 and has a vibrator connected thereto.

The concentrator stratifies by gravity, but in addition the lifting forces of air are utilized to itensify the separating process and particularly to give two main fractions, viz, heavy and large on the one hand, and small and light on the other hand.

This stratifying process is provided by a prestratifying zone 16 followed by a gravity separation zone 17 in which the large heavy fraction falls through an apertured floor. The small and lightweight fraction which is readily lifted by the air flow and which contains, for example, lightweight seeds is obtained as screenings in the bottom of the lightweight separating zone 18. Although the floor of the individual separating zones is in the form of a screen, the air flow, which is adjustable individually for each zone by valves and which is maintained by suction through a spigot 19, makes this a conventional separation, utilizing the difference between gravity and uplift in the air flow, i.e. it is definitely a gravity separation system. Any large foreign constituents can be discharged through an outlet 15.

The lightweight fraction from zone 18 is fed directly to a scourer 30 comprising a scourer rotor 31, a surrounding cylindrical screen 32, and an outlet 33 for the grain. The rotor 31 is driven at 900 to 1500 rpm by a motor 34, so that undesirable lightweight parts are rubbed through the cylindrical screen. Any dust still adhering to the grain particles is removed in a vertical aspiration channel 36 the upper end of which is connected to suction and the lower end of which provides an outlet 37 for sound clean grain.

The large heavy fraction from the zone 17 passes from the outlet to a stone separator 20 which is constructed as described in Swiss patent specification No. 491 685 which is incorporated herein by reference. The product enters the stone separator in the direction of arrow 21, i.e. in opposition to the main direction of travel of the grain which is downwards to the left as viewed in FIG. 1. The entire unit including the separating table 22 is vibrated by means of a vibrator 23 and is supported on spring elements 24. Because of their greater weight the stones rapidly fall on to the separating table 22 which feeds them up to the stone outlet 25 by shaking movements. The large mass of sound grain is readily lifted by an air stream produced by applying suction to an aperture 26 and the particles float, like a liquid, down to the left to the grain outlet 27.

Pre-stratification is carried out in the zone 16 of the concentrator 10 by means of air and the unavoidable fines falling through the screen are collected and pass out through an outlet 12. The relative lengths of the zones 17 and 18 are adjustable by means of a control valve.

It will be apparent from the foregoing that the concentrator does not form specific fractions, but only concentrates a specific mixture. However, since one specific fraction, i.e. the sand, has already been separated in the first stage, a lightweight sandless-fraction can be formed in the concentrator. It is difficult to separate sand in the stone separator and it would subject the scourer to overloading.

Figure 2:
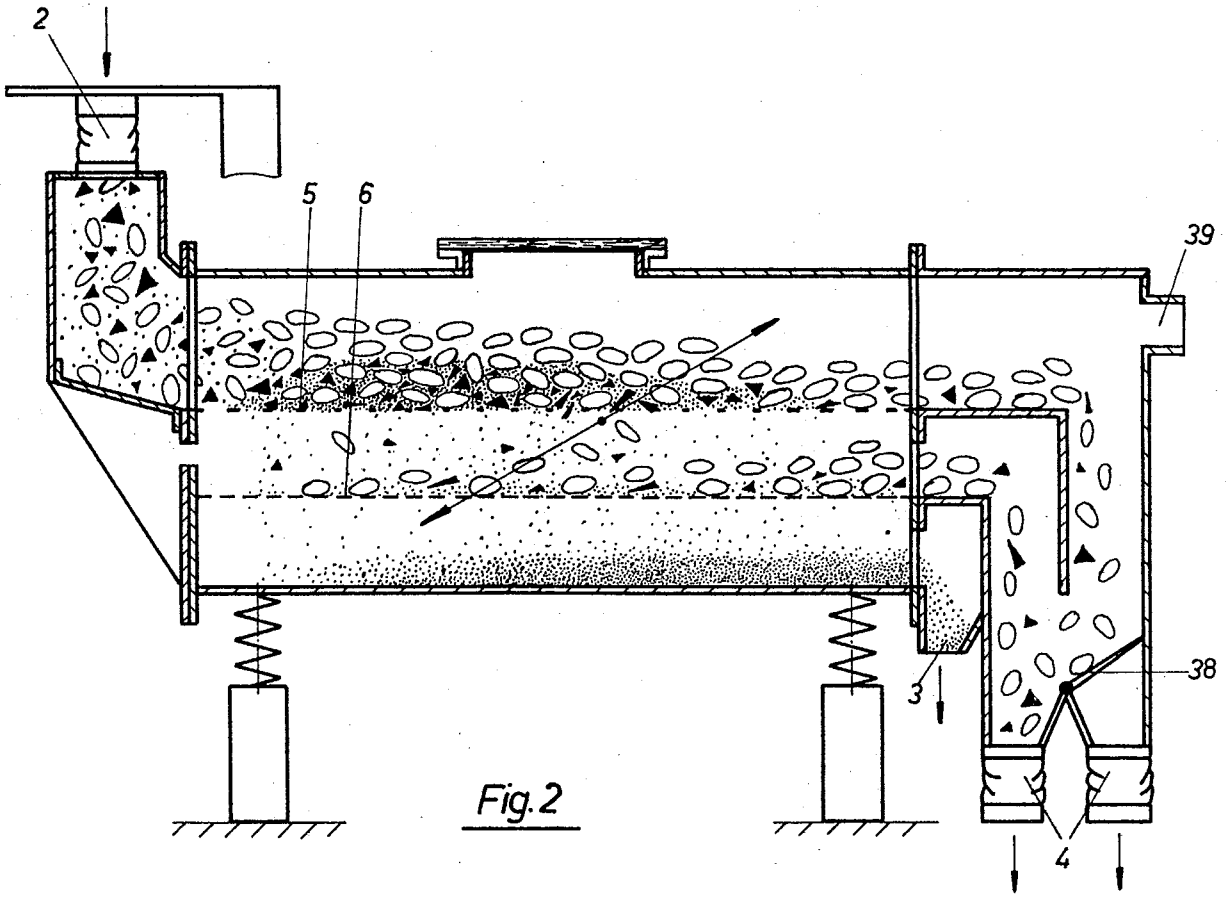
FIG. 2 shows in greater detail a grain separator which may be substituted for that providing the first cleaning stage in the plant shown in FIG. 1.

FIG. 2 is an enlarged view of a grain separator which may be substituted for the separator 1 shown in FIG. 1 and with reference to which the separation operation will be described in greater detail. In this separator only three fractions are shown: elongate pieces are grain, triangular pieces are stones and small dots are sand. The coarse screen shown in FIG. 1 is not present in the separator shown in FIG. 2. Like parts in the two Figures have like references.

It should be noted that the top screen has an effective perforation size larger than the grain particles while the bottom screen has an effective perforation size smaller than the grain particles. The particular size and configuration of the perforations is determined in accordance with the principles well known to designers in the industry and with the grain to be handled; for example the perforations may be hopper shaped and may be in the form of slots instead of circles.

It will be clear from FIG. 2 that the flow of grain on the top screen decreases in depth from the inlet to the outlet, since the layer which contains the small and heavy part and which is compacted at the bottom close to the top screen falls through on to the bottom screen where the thickness of the layer increases from the inlet to the outlet. In both cases optimum conditions assist the success of the invention. Generally, the stratification (above) is best with a relatively deep layer while screening (below) is optimum with a relatively thin layer. However, in the case of very extreme product compositions, it will be easily understood that a relatively thin layer may be desirable on the upper screen and a thick layer on the lower screen. It has been found that the sand falls through predominantly in the first half of the screen. Suction can be applied to the system via spigot 39 in order to extract dust-laden air. Suction, however, must not be set at so high a rate as to lift the grain particles from the screen. The screening operation must not be impaired by the suction. A valve 38 is shown at outlet 4 in FIG. 2, whereby the flow of grain from the top and bottom screens can be combined or kept separate for delivery to the next cleaning stage.

As will be seen from the idealized illustration in FIG. 2, the process on the bottom screen can be designated a conventional screening operation, with the special feature that the material for screening is supplied over the entire length of the screen. This supply appears illogical only at first sight, because as a result of the special operation on the top screen there is practically no sand, but almost only particles of grain and small stones, on the last part of the bottom screen.

The operation which occurs on the upper screen is believed to be novel, at least in this context. However, it is not yet possible to explain which technical process this comes closest to, because, quite simply, the conflicting factors, such as the compacting function (like concrete vibration), gravity separation (like the stone separator), the screning function, and the mixing function (by vibration) all play a part. It is therefore proposed to designate the operation on the top screening layer a "sedimentation". The bottom sedimented layer is allowed to fall through the screen-like floor during and after the formation of the layer. The thickness of the layer at the upstream end portion of the top screen should be at least several centimeters, e.g. 5 to 10 cm, and possibly up to 20 cm or more. The perforations in the upper screen need not be the same either in size or distribution over the entire length.

Figure 3:
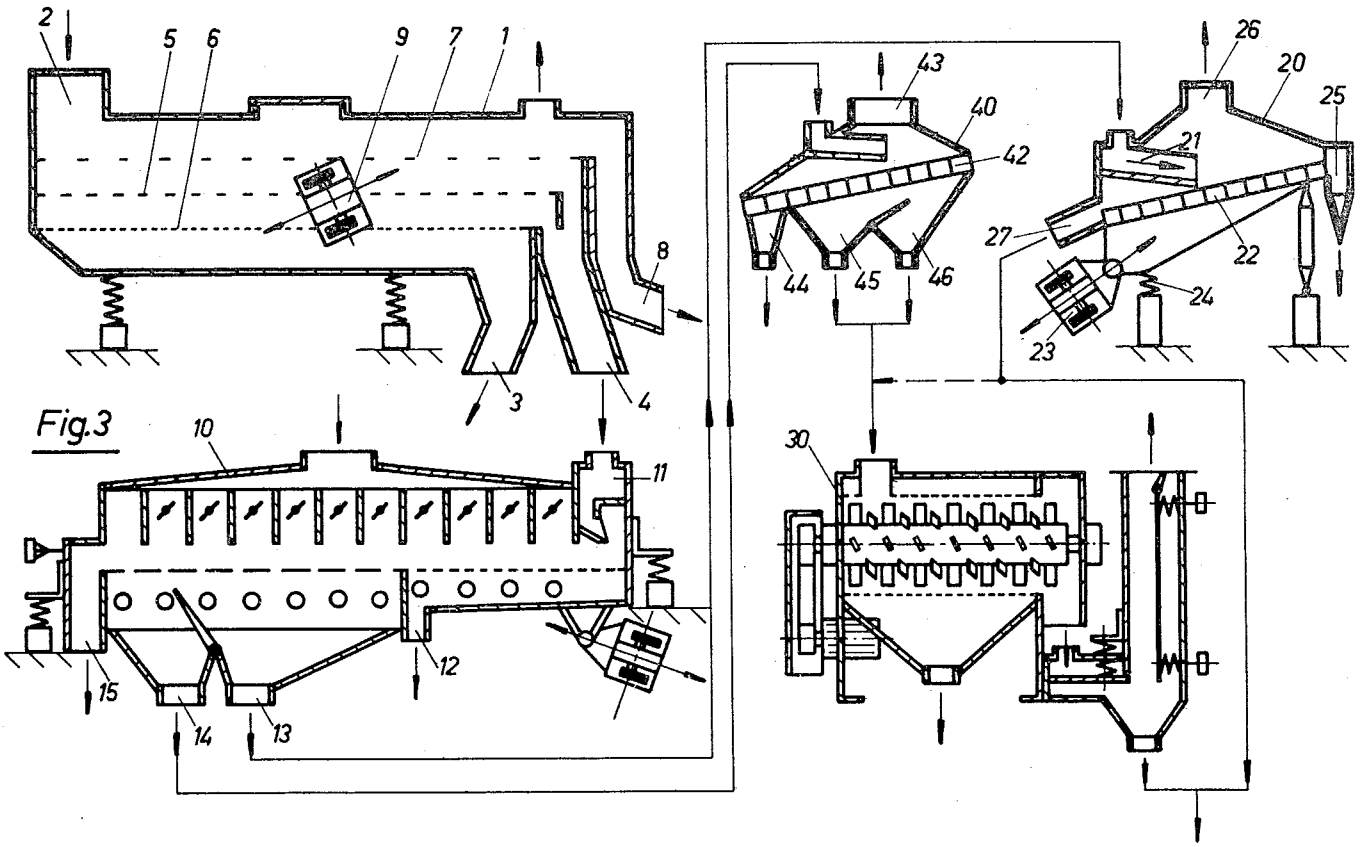
FIG. 3 is similar to FIG. 1 and shows a grain cleaning plant for cleaning hard wheat.

FIG. 3 is very similar to FIG. 1 and shows the cleaning plant of a hard wheat mill. Those parts which are the same as in FIGS. 1 and 2 have been given the same reference numerals.

As in the case of the cleaning plant of the soft wheat mill, grain to be cleaned is admitted to a grain separator 1 and then passes to a concentrator 10. Then, the heavyweight fraction from the outlet 13 is passed to the stone separator 20. However, in contrast to the cleaning plant of the soft wheat mill, the lightweight fraction is passed from the concentrator to a vibratory gravity separator 40 comprising an inlet chute 41 disposed some distance from the actual sorting table 42. The whole apparatus is vibrated by a vibrator not shown. The grain is shaken on to the inclined sorting table to loosen the entire fraction. The material is brought into a floating state by means of relatively intensive suction via a suction spigot 43. The lightest parts are driven to the surface by the uplift in the product layer, which is about 1 to 2 cm high, and flow down, as a result of the inclined position of the table 42, to the bottom left in the Figure, i.e. to an outlet 44. The heavier particles remain close to the air-permeable sorting table 42 and are moved to the top outlets 45 and 46 by the vibration. The entire light fraction, seeds, husks, broken grains, and so on, are collected at the outlet 44 and mainly used for animal feed. Two heavy fractions containing the smaller but sound particles of grain are fed, as in FIG. 1, through a scourer 30 and a vertical aspiration channel. The sound fraction obtained from the stone separator is fed to the mill for the production of flour, semolina, and so on. Alternatively, as indicated by the dotted line, it may be passed to the scourer.

Figure 5:
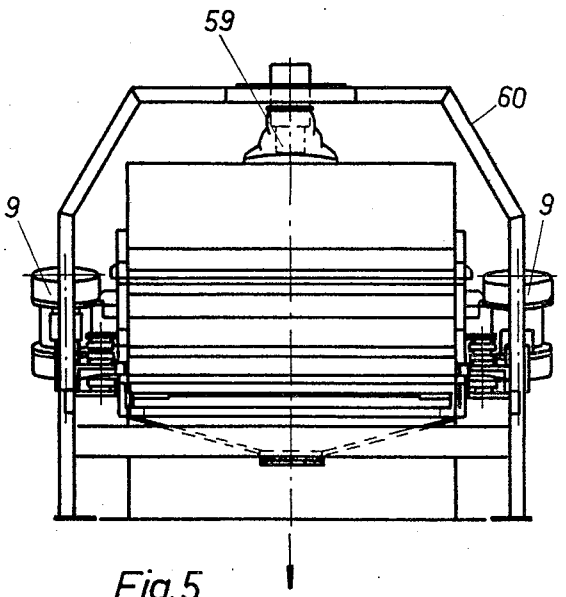
FIGS. 4 and 5 are respectively a side elevation and an end elevation of a further grain separator which can be substituted for the equivalent unit in either of the plants shown in FIGS. 1 and 3 and which is of modular construction.
Figure 4:
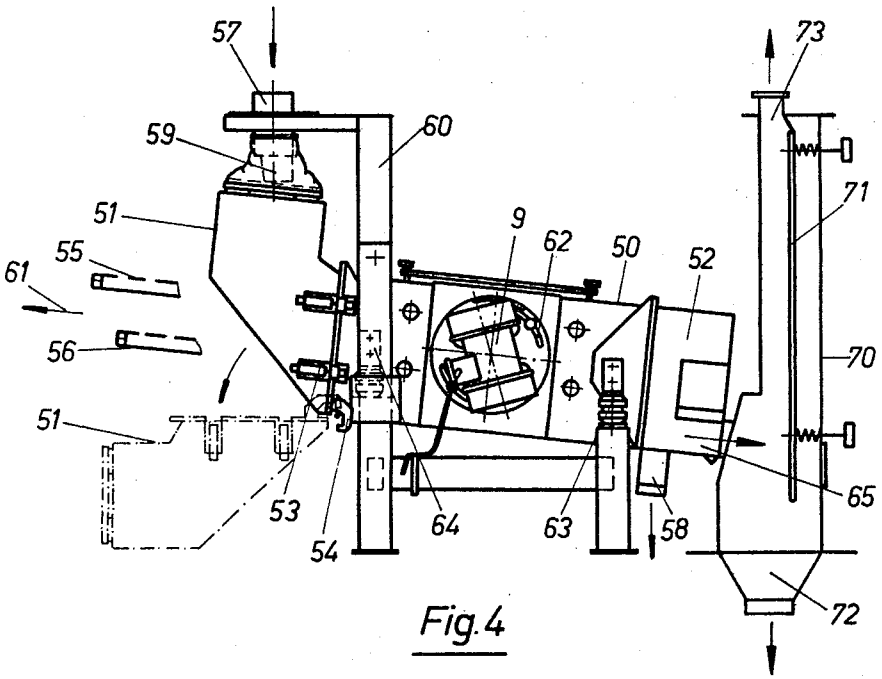

FIGS. 4 and 5 show some structural details of the grain separator 1 of FIG. 1 and show how it is of modular construction. The unit consists more particularly of a screen box 50, which is in the form of a closed trough, a head section 51 and a tail section 52.

As shown in chain-dotted lines, the head section 51 can be swung down about an auxiliary hinge 54 in the form of a hook, after quick-action fasteners 53 have been released. If the equipment is simply to be inspected, this operation alone is sufficient, but if, for example, modifications are to be made to the screens 55, 56, the head section 51 can be completely removed. Since the entire screening system vibrates, the transitions, i.e. the inlets 57 and outlets 58, must be connected by flexible collars 59 to a frame 60 which is a stationary component. When the head section 51 has been removed, the screens 55, 56 and possibly frames supporting the screens and intermediate partitions (not shown) can be withdrawn and inserted after the style of drawers, as shown by arrow 61.

The vibrators 9 are connected to opposite sides of the screen box 50 approximately half way along its length and are attached by bolts passing through arcuate slots in flanges 62 so that the vibrators can be rotated through angles of about 45° to adjust the direction of the vibratory impact. The vibrators are of the rotary eccentric weight type to give a vibration which is effectively linear. The screen box 50 is supported on the frame 60 by damping spring elements 63. The screen box and hence the screens can be lifted or lowered at one end, to adjust the inclination of the unit, by means of adjustable anchorages 64, shown in broken lines on the left of the drawing.

In FIG. 4, the outlet 65 leads directly into a suction duct 70. The linear vibration, together with the regularizing effect of the screening surfaces, results in an ideal feed into the suction duct or aspiration channel 70, which entrains the lightweight husk fractions. The aspiration channel comprises an adjustable wall 71, a grain outlet 72 and a dust-laden air outlet 73.

Figures 6, 7:
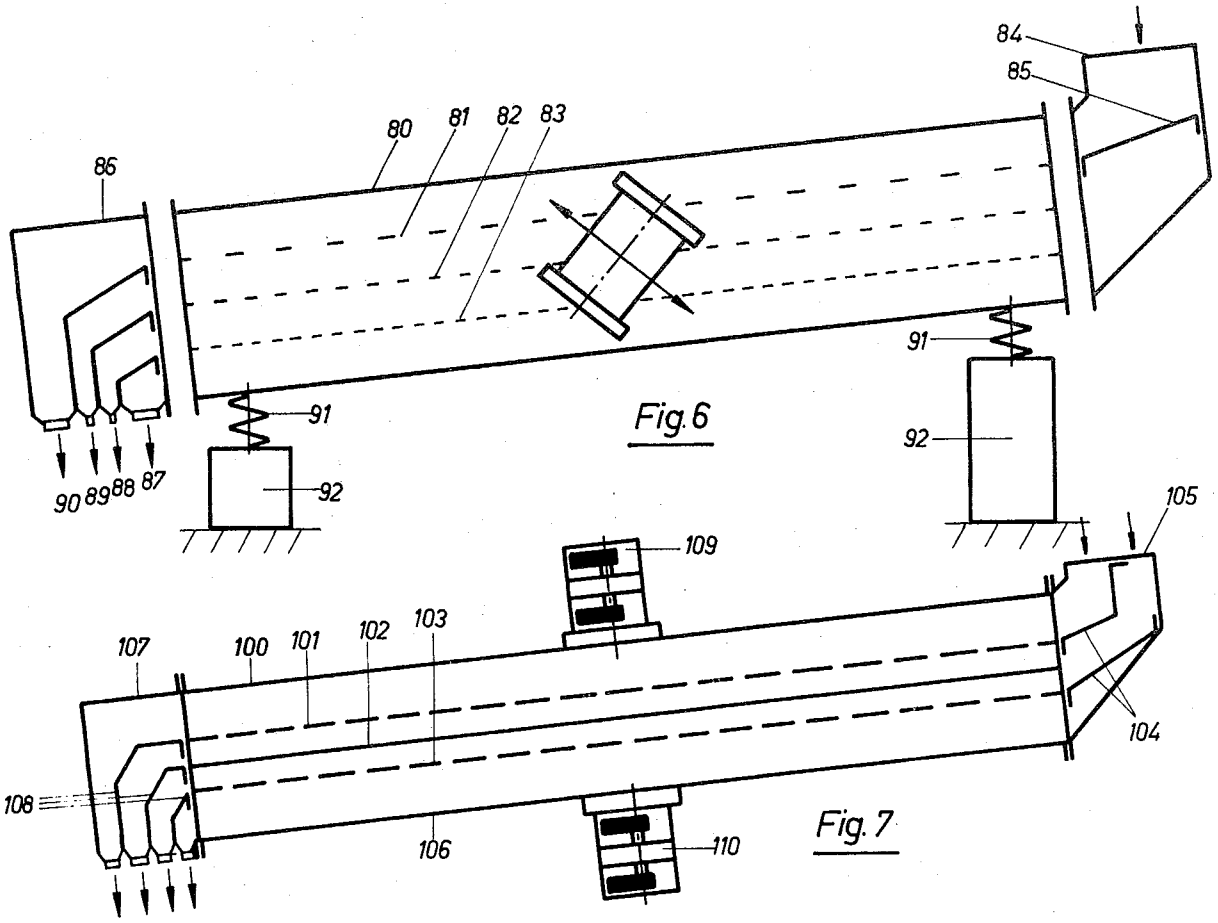
FIG. 6 is a diagrammatic side elevation of the grain separator of FIGS. 4 and 5 showing the modular principle construction.
FIG. 7 is a view similar to FIG. 6 of a further grain separator.
Figure 8:
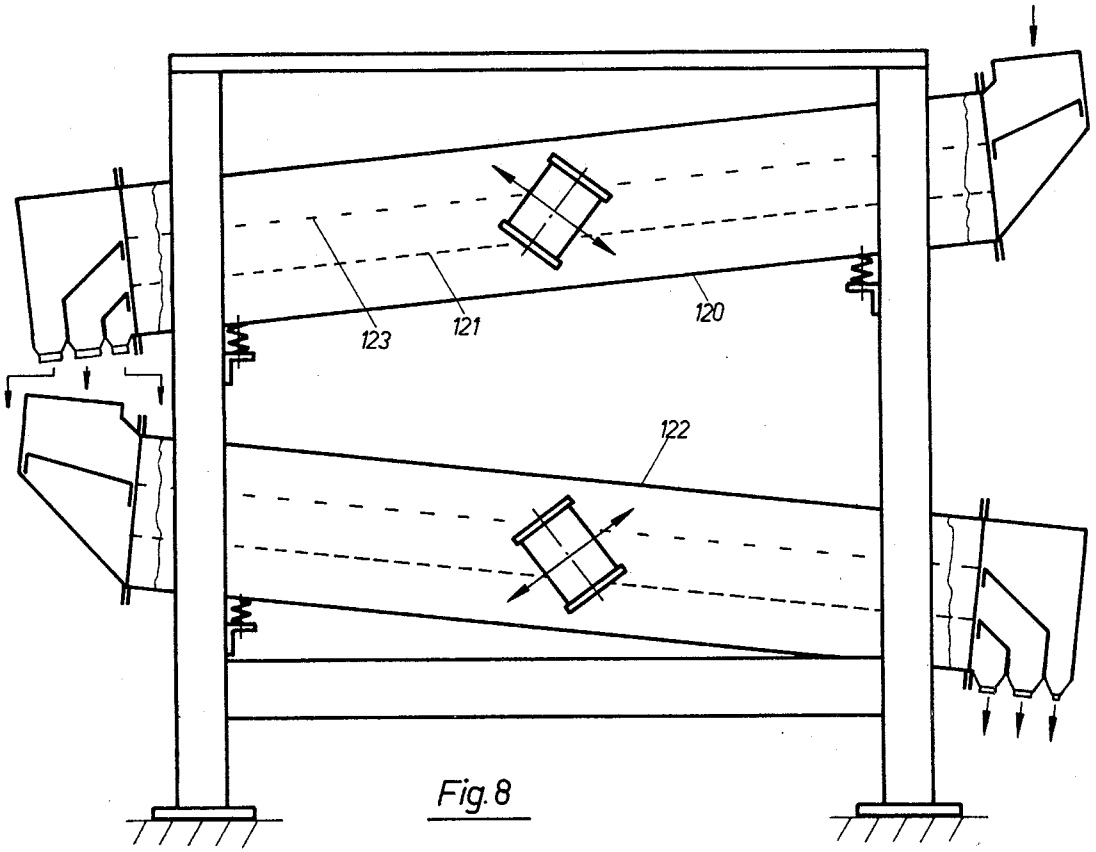
FIG. 8 shows two of the grain separators shown in FIG. 6 combined one above the other.
Figure 9:
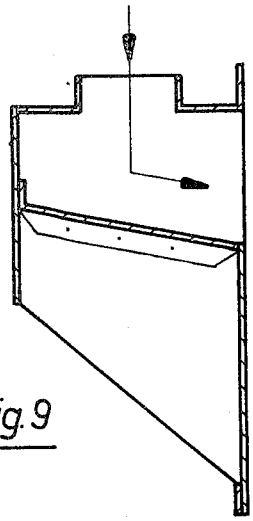
FIGS. 9 and 10 show head sections of grain separators with various fixed flow-pattern guide members.
Figure 10:
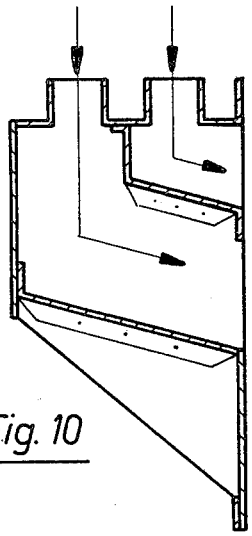
Figure 11:
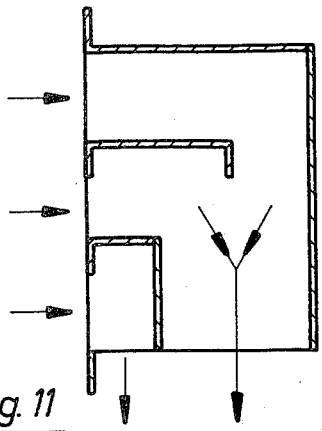
FIGS. 11, 12 and 13 show tail sections of grain separators with various fixed flow-pattern guide members.
Figure 12:
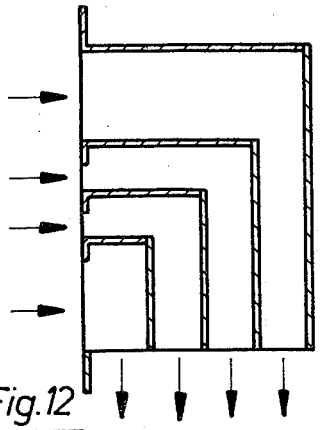

FIGS. 6 to 8 are diagrams showing the construction of different variants using the modular system. In FIG. 6 the closed screen 80 comprises three screening layers, a coarse screen 81, a top screen 82 and a bottom screen 83. The head section 84 is accordingly constructed with just one flow pattern member 85, which feeds the entire flow of grain on to the coarse screen. The tail section 86 comprises four outputs 87 to 90. The eccentric weight type vibrators are mounted on the sides of the box 80 as in the preceding examples. The screen box is borne by spring elements 91, on a symbolically indicated foundation structure 92.

In FIG. 7 the screen box 100 comprises two parallel runs. It comprises a top screen 101, an intermediate floor 102, and a bottom screen 103. The flow pattern members 104 are disposed accordingly in the head section 105. The floor 106 of the screen box 100 collects the screenings from the bottom screen 103. The tail section 107 also has the necessary flow pattern members 108 to enable the individual fractions to be delivered as required through the corresponding outlets. Unlike the previous constructions, FIG. 7 shows a vibratory drive which gives a circular movement of the kind conventional in plan sifters. Transverse movement of the material is desirable for special separation problems. Of course the unit can be expanded transversely without any limitation. As diagrammatically shown, two rotary eccentric weight type vibrators 109 and 110 are respectively disposed at the top and bottom of the screen box. Movement of the eccentrics, which here are disposed approximately centrally, are counterbalanced by movement of the screen box and give a relatively smooth gyratory movement.

FIG. 8 is an example of a combination of two grain separators in a single unit. The upper separator 120 is of similar construction to that shown in FIG. 2 and has three outlets. Only the retained material from the bottom screen 121 is fed to the bottom separator 122 which is of the same construction as the upper. The retained material from the top screen 123 is not fed to the bottom screen. FIG. 8 gives an indication of the versatility of the possible combinations, all of which can be constructed with the minimum additional means from the same basic unit. By changing the flow pattern members in the tail unit of the upper separator the retained material from the first screen or the retained material from the second screen or the screenings from the second screen can be fed to the next screening unit just as required.

Of course two screen boxes can be disposed side by side in a tandem construction. In that case it may be advantageous to select a gyratory vibration with an approximately vertical axis on the lines of FIG. 7, and dispose the vibrator in the middle between the two screen boxes.

FIGS. 9 to 13 show a number of head and tail sections having various fixed flow pattern members. The term flow pattern members denotes either the individual product guide plates or all such plates together. It will also be seen from the Figures that the head and tail sections form flow pattern boxes, the flow pattern members forming a permanent unit with the outer casing of the head or tail section. To change the product guidance, a different head or tail section must be used. The modular system can be expanded by making the individual flow pattern members adjustable individually within the head or tail sections, for example by providing a plurality of positions in each section in which they can be clamped or bolted. In a third possibility, the flow pattern members are made up into units which fit into empty head or tail sections so that a different flow pattern can be selected by retaining the existing head or tail section but exchanging the flow pattern unit contained therein.

Figure 13:
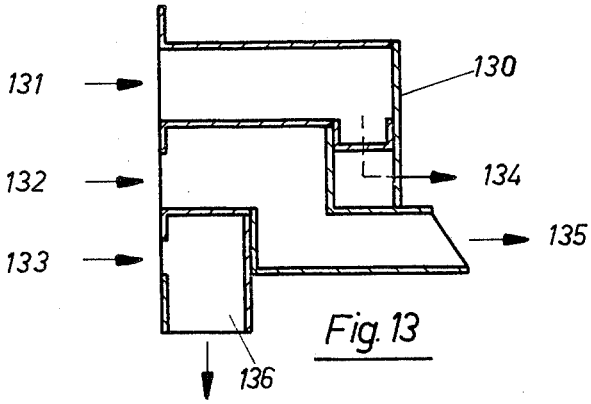

FIG. 13 shows a special construction of tail section 130. This comprises three inlets 131, 132, 133, e.g. as shown in FIG. 2. The special feature here is simply that a special outlet member is provided in which one outlet 134 discharges laterally, one outlet 135 discharges in the longitudinal direction of the screen and one outlet 136 leads downwards. The tail section 130 corresponds to FIG. 4, in which the grain is fed directly into a vertical aspiration duct. This will show that the way has now been opened for a hitherto unimagined number of different combinations, both in terms of process engineering and structurally, for the screen, which was hitherto rather neglected in applied process engineering.

What we claim as out invention and desire to secure by Letters Patent is:

1. Screening apparatus for the dry cleaning of grain by removal of impurities, the apparatus comprising a casing of modular construction including a screen box in the form of a closed trough and housing at least one removable screen, a head section detachably mounted at one end of said screen box, said head section incorporating an inlet and internal guide means for directing material entering said inlet to one side of said at least one removable screen, a tail section incorporating a plurality of outlets and internal guide means for directing material passing through said at least one screen to one of said outlets and material retained by said at least one screen to another of said outlets, said screen box having means for accommodating different numbers of interchangeable screens and said guide means of said head and tail sections being adapted to be interchangeable with other such guide means, thereby providing different flow paths through said apparatus in dependence on the form and number of screens fitted in said screen box, wherein said head section is held in position by quick action releasable catches.

2. Apparatus according to claim 1 wherein said head section is connected to said screen box by a hinge and can be swung clear when said releasable catches are released.

3. Apparatus according to claim 1 wherein said internal guide means of said tail section comprise a plurality of product flow guides each of which is individually removable from said tail section.

4. Apparatus according to claim 1 wherein said internal guide means of said tail section comprise a plurality of product flow guides which together form an assembly which is removable as a unit from said tail section.

5. Apparatus according to claim 1 wherein said internal guide means of said tail section includes a flow guide which is permanently secured to the remainder of said tail section.

6. Apparatus according to claim 1 which includes vibrating means mounted on said screen box adjacent the center thereof and adapted to apply substantially linear vibrations to said screen box in a direction inclined with respect to the length thereof.

7. Apparatus according to claim 6 wherein said vibrating means comprises two rotary eccentric vibrators mounted one on each side of said screen box, approximately midway along its length and positioned to rotate about an axis inclined to the horizontal.

8. Apparatus according to claim 6 wherein said vibrators are adjustably mounted on the screen box.

9. Apparatus according to claim 1 which includes vibrating means mounted on said screen box, said vibrating means comprising two rotary eccentric vibrators mounted one above and one beneath the screen box with the axes of said vibrators approximately vertical, thereby applying to said screen box vibrations approximately in the plane of the screens in said screen box.

10. Apparatus according to claim 1 wherein there is further provided a separating floor dividing said screen box into two superposed and independent sections, and wherein said head section includes means for directing material flow into each of said superposed independent sections.

11. Apparatus according to claim 1, wherein said head section and said tail section of said apparatus are interchangeable with other such head and tail sections, respectively having internal guide means of different form, thereby effecting the interchange of guide means so as to provide said different flow paths through said apparatus.

12. Apparatus according to claim 1, wherein said internal guide means of said head section comprise a plurality of product flow guides each of which is individually removable from said head section for replacement by another such product flow guide of different form.

13. Apparatus according to claim 1, wherein said internal guide means of said head section comprises a plurality of product flow guides which together form an assembly which is removable as a unit form said head section.

14. Screening apparatus for the dry cleaning of grain by removal of impurities, the apparatus comprising a casing of modular construction and consisting of:

a screen box in the form of a closed trough;

means in said screen box for receiving and positioning a plurality of removable screens;

a plurality of screens received in said receiving means, each said screen having a first side and a second side, said screens defining a plurality of chambers in said screen box, a head section containing an inlet and releasably connected to one end of said screen box by quick action releasable catches;

inlet guide means in said head section for guiding material from said inlet to said first side of each of said plurality of removable screens;

a tail section containing a plurality of outlets and connected to the other end of said screen box;

outlet guide means in said tail section for guiding material from each of said chambers to respective ones of said outlets.

15. Apparatus according to claim 14 wherein said screens in said screen box are slidably mounted in said receiving means whereby the screens can be withdrawn longitudinally from said box after release of said head section.

16. Apparatus according to claim 15 wherein said head section is also connected to said screen box by a hinge.

17. Modular screening apparatus for the dry cleaning of grain by removal of impurities, the apparatus comprising a casing including a screen box in the form of a closed trough and having means for receiving a selected number of interchangeable removable screens, a plurality of modular head sections each selectively mountable at one end of said screen box by quick action releasable catches, each said head section incorporating an inlet and internal guide means of different form from the internal guide means of the other head sections of said plurality of head sections, for directing material entering said inlet to one side of each of said selected number of removable screens, a plurality of tail sections incorporating a plurality of outlets and internal guide means of different form from the internal guide means of the other tail sections of said plurality of tail sections, for directing material passing through said selected number of screens and material retained by said selected number of screens to respective outlets, said plurality of tail sections being interchangeable with each other, thereby providing different flow paths through said apparatus in dependence on the form and number of screens fitted in the screen box.

* * * * *